US006722036B2

(12) United States Patent
Pratt

(10) Patent No.: US 6,722,036 B2
(45) Date of Patent: Apr. 20, 2004

(54) METHOD OF MAKING SELF-STOPPING BEADS

(76) Inventor: Ronald Pratt, 223 Reservoir Rd., Cumberland, RI (US) 02864

( * ) Notice: Subject to any disclaimer, the term of this patent is extended or adjusted under 35 U.S.C. 154(b) by 0 days.

(21) Appl. No.: 10/368,735

(22) Filed: Feb. 19, 2003

(65) Prior Publication Data

US 2003/0121150 A1 Jul. 3, 2003

Related U.S. Application Data

(62) Division of application No. 09/834,326, filed on Apr. 13, 2001, now Pat. No. 6,557,376.

(51) Int. Cl.[7] ..... A44C 27/00

(52) U.S. Cl. ..... 29/896.41; 29/417; 29/516; 29/896.42; 72/416

(58) Field of Search ..... 29/896.41, 896.42, 29/896.43, 417, 516; 72/71, 98, 118, 416

(56) References Cited

U.S. PATENT DOCUMENTS 973,153 A * 10/1910 Wolcott ..... 29/896.41
2,852,923 A * 9/1958 Gamelsky ..... 63/20
3,284,882 A * 11/1966 Marchesan ..... 29/433
5,581,884 A * 12/1996 Iacono et al. ..... 29/896.41
6,470,571 B1 * 10/2002 Namiki ..... 29/896.41
6,557,376 B2 * 5/2003 Pratt ..... 63/3

* cited by examiner

*Primary Examiner*—Essana Omgba
(74) *Attorney, Agent, or Firm*—Cesari and McKenna, LLP

(57) ABSTRACT

A jewelry article includes an elongated support and a multiplicity of ornaments strung along the support, at least one of which constitutes an adjustable self-stopping bead. Each self-stopping bead has a rigid shell with a pair of holes sized to slidably receive the support. A flexible resilient tube is positioned inside the shell in alignment with the holes that tube having a length that is as great as or slightly greater than the spacing of the holes, an outside diameter that is slightly larger than the diameter of the holes and in inside diameter that is slightly smaller than the maximum cross-sectional dimension of the support so that the tube resiliently engages the support to adjustably fix the position of the self-stopping bead along the support. A method of making the self-stopping bead is also disclosed.

13 Claims, 1 Drawing Sheet

METHOD OF MAKING SELF-STOPPING BEADS

CROSS-REFERENCE TO RELATED APPLICATIONS

This application is a divisional of Ser. No. 09/834,326, filed Apr. 13, 2001, now U.S. Pat. No. 6,557,376.

BACKGROUND OF THE INVENTION

1. Field of the Invention

This invention relates to jewelry. It relates more particularly to such jewelry consisting of an array of beads or other ornaments strung on a support such as a chain or wire.

2. Description of the Prior Art

Necklaces often consist of a multiplicity of beads strung on an elongated slender support, e.g. chain, wire, string, etc., which can be hung around a person's neck so that the necklace falls on the person's chest area. In some cases, the number of beads on the support is such that the beads occupy substantially the entire length of the support. In other cases, the beads are arranged in groups spaced apart along the length of the support with the beads in each group often having different sizes. In the latter event, steps must be taken to provide stops for at least the end beads of each group in order to maintain the integrity of each group and the spacing between adjacent groups along the support. Often the stops consist of drops of solder on the support that bracket each group. In the case of chains, the bracketing links may be flattened or deformed in some way so that they cannot pass through the holes in the adjacent beads. When the bead support is a string, the string can be knotted at the opposite ends of each bead group.

Conventional necklaces and other jewelry of this type are disadvantaged in that once the beads or other ornaments are strung, there is no possibility to rearrange them along the support. As one may imagine, this limits the utility of the necklace or other jewelry article. For example, while a given woman's necklace may coordinate well with one dress or blouse, it may not look pleasing with another dress or blouse having a different style or neckline. Consequently, a woman may have to purchase many different necklaces in order to satisfy her wardrobe requirements. Needless to say, this can result in a considerable expense, particularly if the necklaces are of a precious metal such as silver or gold.

SUMMARY OF THE INVENTION

Accordingly it is an object of the present invention to provide a beaded belt, necklace, bracelet, anklet and or other jewelry article whose beads can be arranged in different groupings along a chain or other elongated support.

Another object of the invention is to provide a jewelry article comprising a plurality of beads and/or other ornaments strung on a support wherein the beads and/or other ornaments can be adjustably grouped along the support.

Still another object of the invention is to provide a necklace or other jewelry article comprising an elongated slender support having one or more beads adjustably positioned along the support.

A further object of the invention is to provide an adjustable self-stopping bead for a necklace or other jewelry article.

Yet another object of the invention is to provide a method of making an adjustable self-stopping bead for a necklace and or other jewelry article.

Other objects will, in part, be obvious and will, in part, appear hereinafter.

The invention accordingly comprises the several steps and the relation of one or more of such steps with respect to each of the others, and the article possessing the features, properties and relation of elements, which are exemplified in the following detailed description, and the scope of the invention will be indicated in the claims.

Briefly, jewelry incorporating my invention includes an elongated slender support having strung thereon a multiplicity of beads and/or other ornaments one or more of which is a self-stopping bead whose position along the support can be adjustably fixed. This allows the beads or other ornaments on the support to be variably grouped along the length of the support to suit the desires of the wearer. The support may be any one of a variety of known members such as a chain, solid or braided wire, tubular wire, string, monofilament wire or the like.

Each of the adjustable self-stopping beads comprises a hollow shell having a pair of holes therein through which the bead support may be threaded. The bead also has incorporated therein at the time of its manufacture a short flexible resilient tube which is aligned with the holes in the shell and preferably compressed between the opposite ends of the shell so that the tube remains aligned with the holes. When that bead is strung on the support, the segment of the support within the tube is resiliently engaged by the wall of the tube such that an appreciable force is required in order to slide that bead along the support. Consequently, the self-stopping beads allow the variable grouping of other, freely slidable, beads or ornaments along the support. For example, when a beaded necklace incorporating my invention is hung around the wearer's neck to form a loop, a self-stopping bead and all of the other beads above it on the loop can be grouped at a selected elevation on the necklace. In the case of a bracelet or belt, the beads or other ornaments may be variably grouped around the wearer's wrist or waist. As will be seen, a wide variety of different ornamental groupings are possible for a given piece of jewelry.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF AN ILLUSTRATIVE EMBODIMENT

Figures 1A, 1B, 1C:
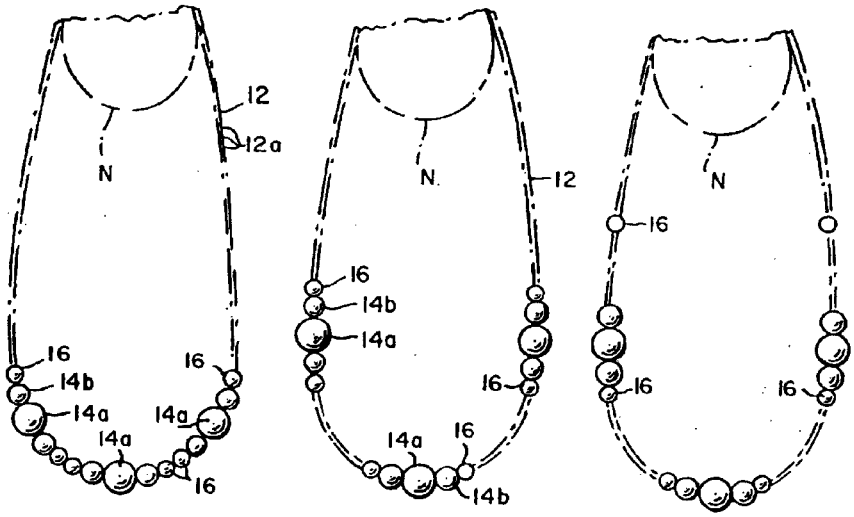
FIGS. 1A–1C are elevational views of a beaded necklace including adjustable self-stopping beads incorporating my invention positioned at different elevations on the necklace to establish different bead groupings on the necklace.

Referring to FIGS. 1A to 1C of the drawings, a necklace 10 incorporating the invention is shown hung around a wearer's neck N. The illustrated necklace includes a bead support in the form of a chain 12 composed of interlocking links 12*a* which may be of any metal or other material suitable for making jewelry. When in use, the chain 12 forms a loop around the wearer's neck as shown. The illustrated necklace 10 has relatively large beads 14*a* and somewhat smaller beads 14*b* on opposite sides of each bead 14*a*. The necklace also includes a plurality of adjustable self-stopping beads 16. In the illustrated necklace, the beads 16 are smaller than beads 14*b* and there is a self-stopping bead 16 adjacent to each bead 14*b*. The beads 16 enable all of the beads to be adjustably grouped along chain 12. Thus in one necklace format, all of the beads can be clustered at the lower end of the necklace as shown in FIG. 1A. Alternatively, the two left-most self-stopping beads 16 may be raised up on the left-hand stretch of the necklace and the two right-most beads 16 may be raised up on the right-hand stretch of the necklace to form two upper bead groupings as shown in FIG. 1B, leaving a third bead group at the bottom of the necklace. In another variation, the two end beads 16 on the necklace can be moved farther up on the chain 12 to provide still another design effect. Thus, by variously positioning the self-stopping beads 16 along chain 12, the single necklace can be transformed to have a variety of different bead configurations to coordinate with the different garments in the wearer's wardrobe.

While necklace 10 has only one ornamental strand it is obvious that the invention can be incorporated into a multiple strand necklace which would allow a variety of different bead grouping along the different strands.

Figure 2:
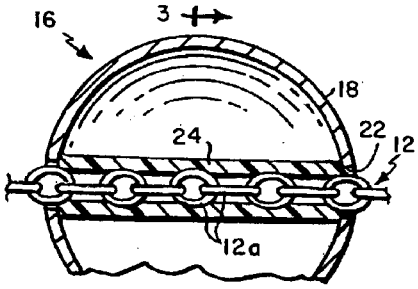
FIG. 2 is a view in medial section on a much larger scale showing one of the adjustable self-stopping beads in the FIG. 1 necklace.
Figure 3:
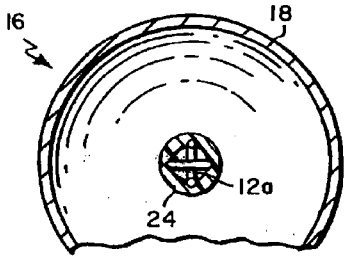
FIG. 3 is a sectional view taken along line 3—3 of FIG. 2.

Referring now to FIGS. 2 and 3, each self-stopping bead 16 comprises a thin shell 18 of any metal, alloy or other deformable material suitable for making jewelry, e.g. gold, silver, platinum, stainless steel, brass, etc. The shell 18 has a pair of opposing holes 22 sized to receive the chain 12 so that the bead 16 can be strung on the chain. At the time of its formation, the shell 18 is provided with an internal tube 24 which is aligned with holes 22. Preferably, tube 24 is of a flexible resilient material, e.g. polyethylene, polyvinyl chloride, rubber, etc. Due to the method of installing the tube in shell 18 as will be described presently, the outside diameter of the tube is slightly larger than the diameter of holes 22 and the inside diameter of the tube is slightly smaller than those holes and the tube is compressed between the ends of the bead so that it remains aligned with the holes even if the bead is impacted or jostled. When the bead 16 is strung on chain 12, the links 12*a* of the chain within the tube are resiliently engaged by the tube wall such that when the bead 16 is slidably positioned at a selected location on chain 12, the bead remains at that location until an appreciable force is applied to slide the bead to a different location along the chain.

Figure 4A:
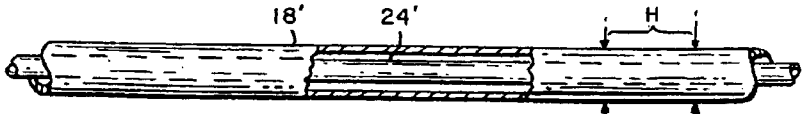
FIG. 4A is a sectional view with parts in elevation showing the components used to form the FIG. 2 bead.
Figure 4B:
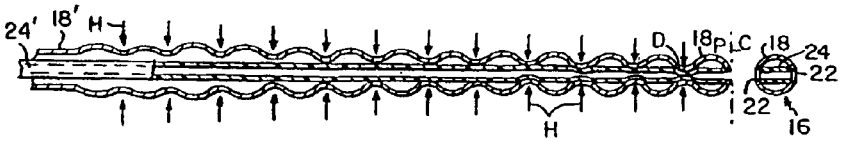
FIG. 4B is a similar view illustrating the method of making the FIG. 2 bead.

Referring now to FIGS. 4A and 4B, the beads 16 are formed from a long tube 18' by progressively deforming the tube in accordance with well-known bead-forming methods. However, prior to carrying out the steps of those methods, a small diameter flexible resilient tube 24' is inserted into tube 18'. Preferably tube 24' is as long as or longer than tube 18'. Following insertion of the tube 24' in tube 18', while rotating tube 18' about its longitudinal axis, the tube 18' is advanced past a succession of hammers or dies indicated schematically by the arrows H in FIG. 4B. The hammers H drive progressively closer to the rotary axis so that tube 18' is progressively deformed as indicated in FIG. 4B as viewed from left to right. In other words, the first hammer H makes a slight circular deformation in the otherwise straight tube 18'. That circular deformation then travels to the second hammer which makes a slightly deeper deformation in the tube. That slightly deeper deformation is then advanced to the third hammer which deepens the deformation even more and so on until the tube is deformed or crimped to such an extent that the wall of the tube 18' is necked down so that it actually pinches the resilient tube 24' as shown at D in FIG. 4B. At that point, the diameter of the tube 18' has been reduced to an extent that it is almost pinched off so an end segment of the tube forms a more or less spherical protoshell $\mathbf{18}_p$ which is connected to the rest of tube 18' only at the small neck remaining at the depression D. Tube 18' is then advanced past a cutter C which cuts the tubes at the depression D so that the protoshell $\mathbf{18}_P$ and the resilient tube segment therein are separated from the remainders of tubes 18' and 24', respectively, thereby forming a self-stopping bead 16 with holes 22 as shown in FIG. 4B.

The particular shape of beads 16 is determined primarily by the shapes of the hammers or dies and the cross-sectional shape of tube 18'. In the illustrated necklace, the hammers H are spaced-apart a distance comparable to the cross-section of tube 18 so the beads are round. But many other bead shapes are possible, e.g. cube, polyhedron, oblate spheroid, etc. For example, if the die hammers are spaced-apart a distance greater than the cross-section of tube 18' as shown in phantom in FIG. 4A, an elliptical football-shaped bead will result.

The progressive deformation of the tube 18' to form the protoshell $\mathbf{18}_p$ apparently compresses and/or deforms the resilient tube 24' inside the protoshell both radially and axially such that when the shell 18 and its tube 24 are separated from the remainders of tubes 18' and 24', respectively, the tube 24 within shell 18 resumes its unstressed state so that it has inside and outside diameters which bracket the hole 22 diameter and a length which fits resiliently within shell 18 such that the ends of the tube 24 remain aligned with holes 22 in the shell but do not project at all through those holes. In other words, during the bead formation process, the shell 18 and the tube 24 are pinched off so that the shell holes 22 have a slightly smaller diameter than the unstressed outer diameter of tube 24 and the length of that tube is at least as great as the spacing of those holes. Thus, once the bead 16 is formed, the tube 24 therein remains aligned with the holes 22 so that chain 12 can be threaded through the bead.

The links 12*a* of chain 12 which are sized to fit through the holes 22 in shell 18 have a maximum diameter or width which is slightly larger than the inside diameter of tube 24 so that the links are resiliently engaged by the wall of the tube thereby preventing the free sliding movement of the bead 16 along the chain. That is, in order to move the bead along the chain, the chain should be held stationary and an appreciable force applied to the bead in a direction parallel to tube 24. This causes the wall of shell 18 around a hole 22 to press against the adjacent end of tube 24 thereby applying an axial force to the tube. This causes the tube to expand slightly in diameter thus reducing its frictional engagement with the chain in the same way that one obtains release from a Chinese thumb trap.

The beads 14*a* and 14*b* which do not have a self-stopping capability could be hollow beads formed in the same way described above, but without the insertion of the plastic tube 24' during the manufacturing process. But they could just as well be solid beads, precious stones, tubules or any other ornaments capable of being strung and grouped on their support by self-stopping beads 16.

It will thus be seen that the objects set forth above among those made apparent from the preceding description are efficiently attained. Also, certain changes may be made in carrying out the above method and in the construction set forth without departing from the scope of the invention. For example, the self-stopping beads 16 may be used to adjustably group beads or other ornaments even in small jewelry articles such as earrings, pins and brooches. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A method of making a self-stopping bead for jewelry, said method comprising the steps of:

inserting a resilient tube with an axial passage inside a relatively rigid tube, the two tubes each having opposite ends and being more or less coextensive;

deforming the rigid tube inward at spaced-apart locations along the rigid tube;

continuing the deformation until the rigid tube forms a protobead at one end of the rigid tube, said protobead containing an intact segment of the resilient tube has the axial passage, said protobead being connected to the remainder of the rigid tube solely by an annular neck which radially pinches the resilient tube; and separating the protobead and said intact segment therein from the remainder of the rigid tube at said neck thereby forming a hole in the bead wherein during the step of continuing the deformation to form the protobead, the rigid tube and the resilient tube are pinched off so that the hole in the bead has a slighter smaller diameter than an unstressed outside diameter of the resilient tube and said intact segment of the resilient tube inside the protobead has a length at least as great as an axial length of the protobead whereby once the protobead is separated, said intact segment remains aligned longitudinally in the bead at said hole.

2. The method defined in claim 1 wherein the deforming of the rigid tube is carried out progressively in the direction of said one end of the rigid tube.

3. The method defined in claim 1 including the step of forming the rigid tube of a precious metal or alloy thereof.

4. A method of making a self-stopping bead for jewelry, said method comprising the steps of:

inserting a resilient tube with an axial passage lengthwise into a relatively rigid tube having a longitudinal axis;

deforming the rigid tube inward toward said axis at first and second spaced-apart locations along said axis;

continuing the deformation until the rigid tube is necked down at said locations enough to pinch the resilient tube to define an intact resilient tube segment extending between said locations; and cutting the rigid tube and the resilient tube at said locations thereby forming a self-stopping bead with opposing holes wherein during the step of continuing the deformation to form the protobead, the rigid tube and the resilient tube are pinched off so that each hole in the bead has a slighter smaller diameter than an unstressed outside diameter of the resilient tube and said intact segment of the resilient tube inside the protobead has a length at least as great as an axial length of the protobead whereby once the protobead is cut, said intact segment remains aligned longitudinally in the bead between said holes.

5. The method defined in claim 4 wherein the first and second locations are spaced apart a distance comparable to the cross-section of the rigid tube.

6. The bead defined in claim 4 wherein the distance between the first and second locations is greater than the cross-section of the rigid tube.

7. The method defined in claim 4 including the step of forming the rigid tube with a circular cross-section.

8. A method of making self-stopping beads for jewelry, said method comprising the steps of:

inserting a resilient tube having an axial passage lengthwise into a relatively rigid tube having a longitudinal axis;

incrementing the tubes past a series of equally spaced-apart die sets which crimp the rigid tube towards said axis at spaced-apart locations along the axis;

adjusting the die sets to crimp the rigid tube by progressively greater amounts so that when the rigid tube is incremented past the last die set in the series, a succession of protobeads is formed at a leading end of the rigid tube each of which contains an intact segment of the resilient tube and is connected to the remainder of the rigid tube solely by a narrow annular neck which pinches the resilient tube; and separating each protobead and the intact resilient tube segment therein from the remainder of the rigid tube at the corresponding neck whereby self-stopping beads are formed each of which has opposing holes wherein during the step of adjusting the die sets to form each protobead, the rigid tube and the resilient tube are pinched off so that each hole in the bead has a slighter smaller diameter than an unstressed outside diameter of the resilient tube and said intact segment of the resilient tube inside the protobead has a length at least as great as an axial length of the protobead whereby once the protobead is separated, said intact segment remains aligned longitudinally in the bead between said holes.

9. The method defined in claim 8 including the step of spacing the die sets apart a distance comparable to the cross-section of the rigid tube.

10. The method defined in claim 8 including the step of spacing the die sets apart a distance greater than the cross-section of the rigid tube.

11. The method defined in claim 8 including the step of forming said tubes as cylinders.

12. The method defined in claim 4 including the additional step of stringing said self-stopping bead on a support member whereby substantially the entire length of said intact resilient tube segment contacts said support member.

13. The method defined in claim 8 including the additional step of stringing said self-stopping bead on a support member whereby substantially the entire length of the intact resilient tube segment therein contacts the support member.

* * * * *